US005337547A

United States Patent [19]

Bernard

[11] Patent Number: 5,337,547

[45] Date of Patent: Aug. 16, 1994

[54] CABLE SPLICING VISE APPARATUS

[76] Inventor: Ronald V. Bernard, 3760 Hwy. 101 North #L, Florence, Oreg. 97439

[21] Appl. No.: 421,537

[22] Filed: Oct. 13, 1989

[51] Int. Cl.[5] ..... D07B 7/18; B65H 69/06

[52] U.S. Cl. ..... 57/22; 57/23

[58] Field of Search ..... 57/22, 23, 202

[56] References Cited

U.S. PATENT DOCUMENTS

| | | | |
|---|---|---|---|
| 1,521,906 | 1/1925 | Rohr | 57/22 |
| 2,712,724 | 7/1955 | Schoonover | 57/23 |
| 3,675,407 | 7/1972 | LaRue | 57/22 |
| 4,142,353 | 3/1979 | Bruce et al. | 57/22 |

*Primary Examiner*—Joseph J. Hail, III
*Attorney, Agent, or Firm*—Olson & Olson

[57] ABSTRACT

A portable cable splicing stand comprises a longitudinally elongated base frame arranged to be supported above a ground surface as by removable leg members. A pair of adjustably spaced apart upright members extend vertically from the base frame, and each supports a chain vise arranged to receive and clamp between them a desired length of cable to be spliced. One of the chain vises is mounted on the frame for rotation about the axis of the cable so that with a cable clamped by the vises, rotation of the one vise in the direction opposite the windings of the cable untwists the cable between the vises and opens spaces between the individual strands so that the terminal ends of individual cable strands may be woven therethrough easily and without significant effort. A ratchet assembly engages the rotatable vise mount to releasably lock the assembly against reverse rotation of the vise when the cable is in tensioned condition. A bale assembly is provided adjacent the non-rotating vise to assist in confining a length of cable and maintaining it in a position closely adjacent the chain vise to facilitate handling of the cable while engaging the vise particularly in forming closed loop end splices with large diameter cables.

4 Claims, 4 Drawing Sheets

CABLE SPLICING VISE APPARATUS

BACKGROUND OF THE PRIOR ART

This invention relates to devices arranged to loosen the twisted strands of a length of cable and secure the loosened cable in a stationary position while the length of cable is being spliced, and more particularly, this invention provides a portable cable splicing vise stand which is configured to permit one man to accomplish a cable splice without assistance even in remote areas such as logging fields.

Although some cable splicing vises have been known in the art, such as those disclosed in U.S. Pat. Nos. 2,724,986 and 826,766, no device have been known heretofore in the art which secures a length of cable and provides means by which the cable may be easily untwisted in order to permit a conventional cable splice to be undertaken.

It has heretofore been conventional, in a logging field for example, for a cable splice to be accomplished by spiking a cable to a log or stump with railroad spikes, and driving a marlin spike through the cable between the strands in order to open spaces in the intermediate portion of the cable so that a person can "weave" cable strands between the openings in portion of the cable. One can certainly appreciate the difficulty in the foregoing operation when one considers the effort required to accomplish this operation with a tightly woven cable of an inch or 1½ larger in diameter, with each individual strand being ⅜ths inch or more in diameter. Heretofore in the art, nothing known to the applicant has been provided which substitutes for or assists with the foregoing splicing operation in the field.

SUMMARY OF THE INVENTION

In its basic concept, this invention provides a cable splicing stand configured to securely engage a length of cable with vises at two spaced apart points along the cable, at least one vise being lockably rotatable whereby, by rotating the cable securing vise, the cable may be untwisted between its points of attachment on the stand, and thereby opening up spaces between the cable strands to permit separate, individual cable strands to be woven therethrough to form a finished splice once the conventional weaving process is completed and the cable is again released from the stand.

It is by virtue of the foregoing basic concept that the principal objective of this invention is achieved; namely, the provision of a stand which supports a cable in a convenient position for a splice to be made, and further, a stand which also accomplishes the opening up of spaces between the strands of a cable so that additional strands may be easily inserted therebetween during weaving, the entire operation being easily accomplishable by one individual.

Another object and advantage of this invention is the provision of a cable splicing stand of the class described which is configured to be usable in remote areas such as logging fields and the like where heretofore no such apparatus has been available.

Still another object and advantage of this invention is the provision of a cable splicing stand of the class described which may be supported for use in a variety of convenient ways for versatility of use, such ways including freestanding on a ground surface, straddling fallen logs, and attached to a vehicle by a conventional trailer hitch.

Yet another object and advantage of this invention is the provision of a cable splicing stand of the class described in which the length of the splicing portion of a cable between the spaced apart points of engagement by vises can be easily varied for different types and diameters of cable to be spliced.

A further object and advantage of this invention is the provision of a cable splicing stand of the class described which is collapsible for convenient storage and handling.

A still further object and advantage of this invention is a cable splicing stand of the class described which is of simplified construction for economical manufacture.

The foregoing and other objects and advantages of this invention will appear from the following detailed description, taken in connection with the accompanying drawings of a preferred embodiment.

DESCRIPTION OF THE PREFERRED EMBODIMENT

Figure 1:
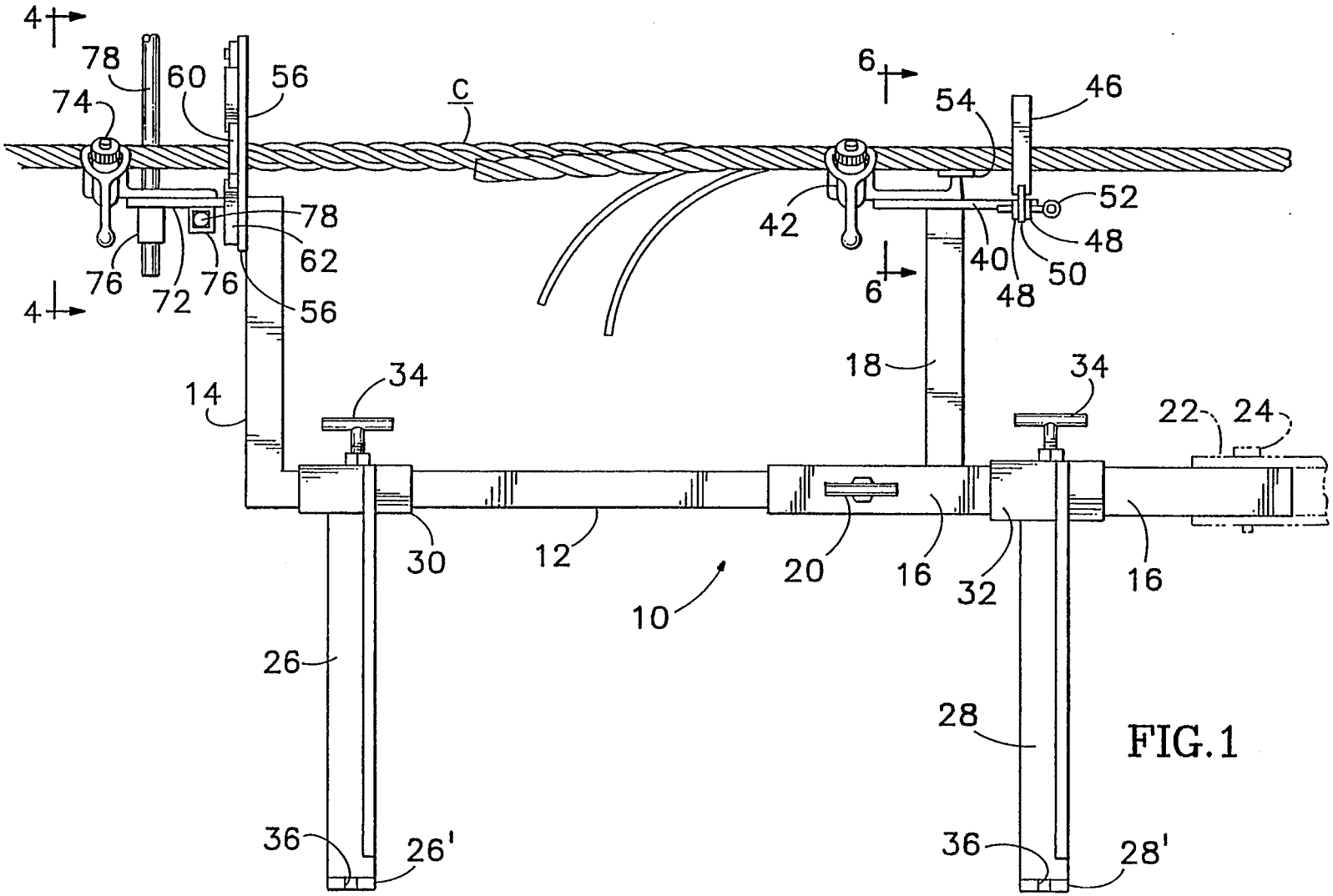
FIG. 1 is a side elevation of a portable cable splicing stand embodying the features of this invention, the drawing illustrating two alternative mounting means by which the stand is supported over a ground surface.
Figure 2:
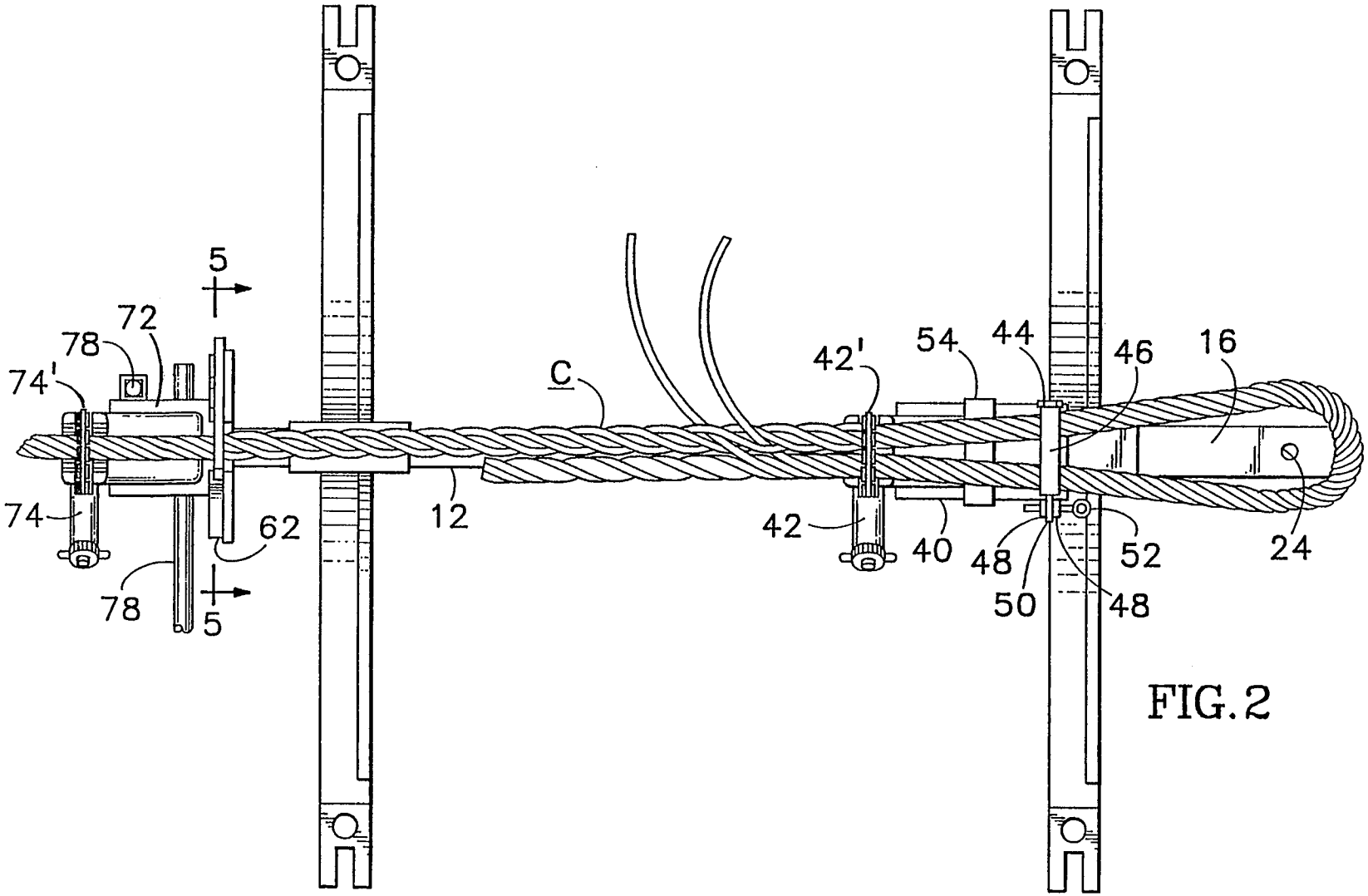
FIG. 2 is a plan view of the cable splicing stand as viewed from the top in FIG. 1.
Figures 3, 6:
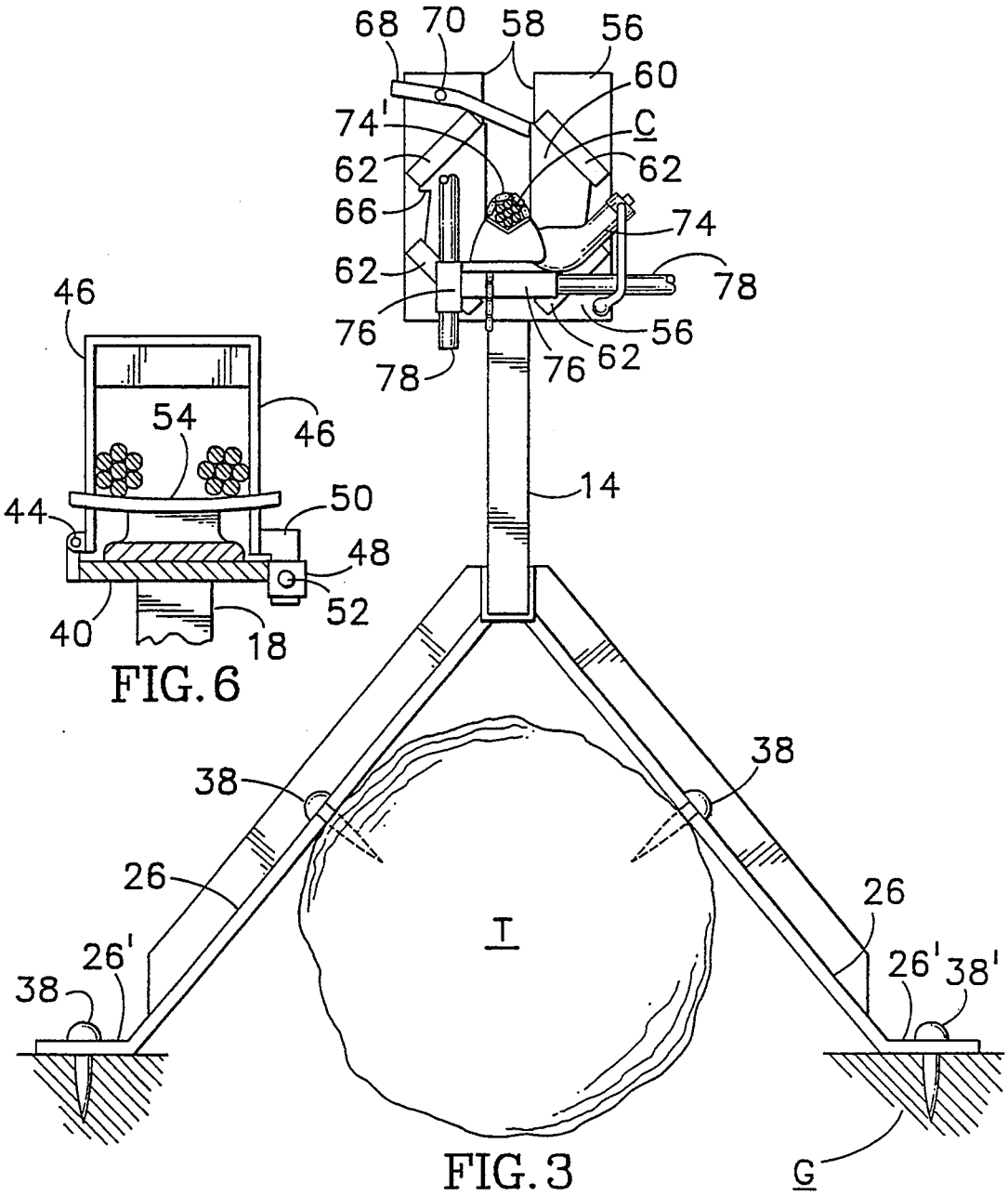
FIG. 3 is a an end view of the cable splicing stand as viewed from the right in FIG. 1, the view illustrating alternative ways that the leg structure may be utilized to support the stand above a ground surface, either by disposition on a ground surface or by straddling a fallen tree trunk.
FIG. 6 is a fragmentary, sectional view of the rear cable support structure taken along the line 6—6 in FIG. 1.

FIGS. 1, 2 and 3 of the drawings show respective side, plan and end views of a preferred embodiment of a cable splicing vise stand embodying the features of this invention, and together thus illustrate the overall basic concept of this invention. As is seen, the stand includes a base frame assembly 10 which comprises, in this embodiment, a first base member 12 formed of a length of box steel. The outer terminal end of the base member 12 mounts an upstanding end member 14.

A second base member 16, formed of box steel having a hollow interior dimensioned sufficiently to receive the first base member telescopically therein, mounts a second upstanding end member 18. Clamp means, illustrated herein as set screw 20, is provided, as is conventional, to frictionally secure the two base sections 12, 16 together in a desired position of longitudinal extension.

Means is provided to support the frame securely above a ground surface. In the embodiment illustrated, two alternative support means are shown. The first, seen in FIG. 1, shows the frame section 16 removably received within a standard box-channel trailer hitch 22 shown in broken lines. Such hitches are common on pickup trucks and the like, and typically include a pin 24 arranged to be received through aligned bores in the hitch members to releasably secure the hitch and the frame member 16 together.

Another means to support the frame above a ground surface is also shown in FIG. 1, as well as in FIGS. 2 and 3. In this version, front and rear upstanding leg members 26, 28 are provided on the frame sections 12, 16 to support the frame securely above the ground for use. As seen, each leg member may be configured as an inverted "V", secured at its closed end to a box channel 30, 32 configured to receive the frame base members 12, 16 respectively. Friction clamp screws 34 provided on the box channels 30, 32 releasably secure the assemblies in desired position on their respective frame base members. In this manner, the leg members may be removed for convenience when the stand is not in use.

The leg members 26, 28 preferably are configured with a foot member 26' 28' arranged to be supported by a ground surface, and may include bores 36 therethrough whereby spikes 38, bolts, screws or the like may be used to secure the legs positively to a ground surface if such a secure and immovable support is required. Out in the field, such as in logging, such floor surfaces aren't available, so the leg members 26, 28 are preferably configured to straddle fallen tree trunks T and the like. If it is necessary to secure the frame in place, spikes 38 may be provided, as shown in FIG. 3, to securely anchor the assembly in position.

It will be appreciated by those skilled in the art that, although FIG. 1 shows the frame 10 mounting leg members 26, 28 while also engaging a trailer hitch 22, these are merely illustrative of alternative support means, and only one such version would be employed at a time. For example, if the stand is secured to the hitch of a truck or other vehicle, the leg members 26, 28 would not be installed on the base frame members 12, 16.

Similarly, although FIG. 3 shows that the legs are being supported both on a log F and on a ground surface G, these are illustrative only, and in use, the legs would be engaging either a ground surface or a tree trunk as the circumstances dictate.

As illustrated, the stand mounts at the upper terminal ends of the front and rear upstanding end members 14, 18, means to receive and secure a length of cable C to be spliced. Referring to the assembly associated with the rear end member 18, a vise-mounting base member 40 is secured to the end member 18 and is configured to mount, in the preferred embodiment, a conventional chain-type pipe vise 42 seen best in FIGS. 1 and 2. Although other types of vises and clamps will work adequately to secure a cable immovably on the stand, the chain-type vise common in plumbing has been found to be the most versatile and convenient for this use.

It is desirable, although not essential, that means be provided to confine a cable in the area adjacent the vise 42, particularly when splices are being done in order to form closed loop ends as is illustrated clearly in FIG. 2. With it understood that these cables may be two inches or more in diameter, it becomes apparent to those skilled in the art that the handling and management of the cable, while also engaging, clamping and operating the vise, can be tedious and rather difficult due to the awkwardness and inherent tension of these large cables.

In this regard, the preferred embodiment of the stand of this invention includes a releasable cable-confining bail assembly disposed rearward of the vise 42. As illustrated in FIGS. 1, 2 and 6, the vise-mounting base member 40 mounts, by pivot hinge 44, an inverted U-shaped bail member 46 configured to pivotally overlie the base member 40 and, together with the base member 40, releasably define a confined area through which the cable may pass, as seen clearly in FIGS. 2 and 6. Cooperating flanges 48, 50 on the base member 40 and the bail 46 respectively include bores (not shown) therethrough which align when the ball is in the closed position shown to releasably receive the lock pin 52 for releasably securing the bail in operative, closed condition.

In order to further ease the proper alignment of the cable preliminary to its engagement by the chain vise, a table saddle 54 may be provided, as shown, to support the cable in proper elevational position relative to the vise.

The forward upstanding end member 14 also mounts means to receive and secure a length of cable to be spliced. In this regard, a vise-supporting base plate 56 is secured to the upper end of the end member 14. As illustrated, the base plate in the preferred embodiment may be configured substantially as a square or rectangular plate mounted for disposition in the upstanding condition shown. The base plate is provided with an elongated slot 58 extending, in the illustrated example, from its upper edge through its middle point. The slot is dimensioned to be at least as wide as the largest diameter of cable that will be served by the splicing stand.

A second, smaller, substantially circular plate member 60 is rotatably mounted on the base plate 56. In the embodiment illustrated, the base plate 56 mounts projecting "L" flanges 62 which define a space in which the circular plate 60 is freely received for rotational movement.

Figure 5:
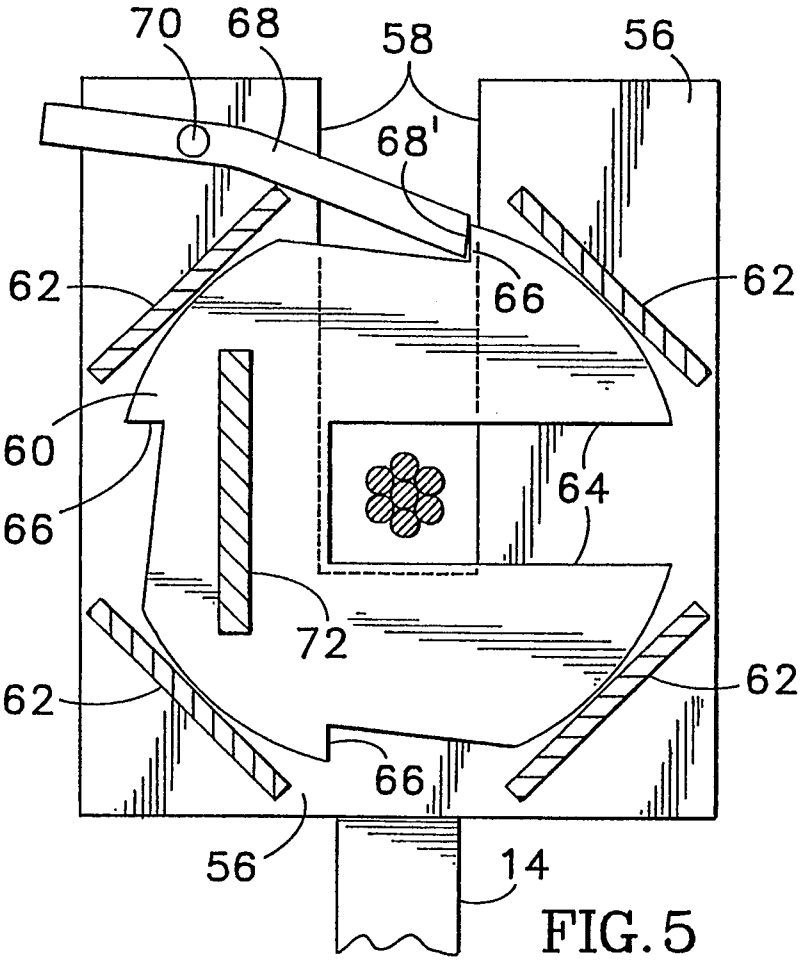
FIG. 5 is a fragmentary sectional view of the vise-mounting rotating plate assembly, taken along the line 5—5 in FIG. 2.
Figure 4:
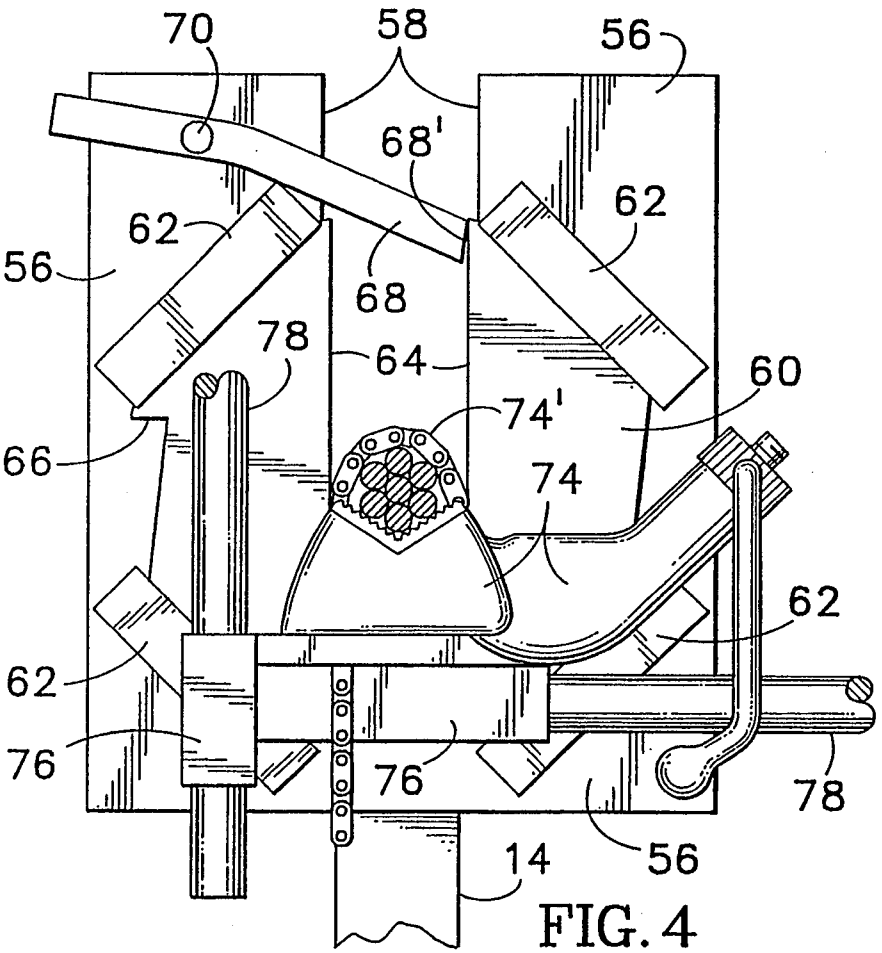
FIG. 4 is a fragmentary end view of the rotatable vise assembly taken along the line 4—4 in FIG. 1.

As illustrated best in FIGS. 4 and 5, the circular plate also includes an elongated slot 64 extending, similar to the slot 58 in the base plate 56, from the outside edge through the middle point, the slot being dimensioned to be at least as wide as the largest diameter of cable that will be serviced by the splicing stand.

Means is provided to selectively and releasably secure the second plate 60 against rotation. A greatly simplified version of locking means is shown in the drawings, but it is to be understood that it is merely illustrative, and other suitable locking means are contemplated as well.

In this embodiment, the outer peripheral wall of the circular plate 60 is configured with notched portions which provide abutment stops 66 (FIG. 5) for a locking bar 68 which is mounted by pivot 70 to the base plate 56. As is apparent, gravity encourages the working end 68' of the bar 68 downward against the outer peripheral edge of the plate 60, e.g. clockwise in FIG. 5, allowing the plate to rotate in one direction, but providing an abutment stop 66 against rotation in the reverse direction. When the working end of the bar drops into one of the notches and engages the confronting edge 66 of that notch, the result is substantially a ratchet effect in which the notched plate is a ratchet wheel and the locking bar is a pawl. Depressing the opposite end of the bar 68 pivots it about the axis of its pivot 70 and removes the working end from engagement in the notched portion of the circular plate, thereby allowing the plate 60 to rotate freely in the opposite (counterclockwise in FIG. 5) direction.

It will be apparent to those skilled in the art that the ratchet assembly just described could also alternatively be configured to permit selective locking in either or both directions of rotation of the plate if so desired. As has been discussed earlier, the stand of this invention is illustrated in its most basic working form so as not to unduly complicate the description and drawings, and so as not to detract from the importance of the invention as a whole.

As is seen most clearly in FIGS. 1 and 5, the circular plate 60 mounts, adjacent the bottom terminal end of the slot 64, a perpendicularly projecting base member 72 which securely mounts a chain-type vise 74 similar to the vise 42 previously described. The vise is mounted on the base member 72 which in turn is mounted on the rotating plate 60 so that the working clamp portion of the vise is disposed substantially on the line that extends through the center of rotation of the plate 60. That line also extends centrally through the corresponding slots 58, 64 and through the working clamp portion of the first vise 42 on the rear end member, as seen in FIGS. 1 , 2, 4 and 5.

Means is provided to facilitate rotation of the vise-mounting structure just described against the inherent tension of the cable secured by the vises 42, 74. In the simplified construction embodied herein, tubular or squared brackets 76 are mounted on the vise-mounting base member 72 and preferably disposed thereon in perpendicularly extending relationship relative to one another. The brackets 76 removably receive an elongated bar 78 which may be grasped by a person, the bar being of sufficient length as to afford the operator an adequate amount of leverage to rotate the assembly against the tension of a cable to untwist a cable into a loosened condition in which the individual cable strands are easily separated, as is clearly illustrated in FIGS. 1 and 2.

Having thus described the basic structure of the present invention, the operation of the preferred embodiment illustrated is as follows:

If it is convenient for the stand to be supported by a trailer hitch, the rear section of the stand being carried by the second base member 16 is installed first by sliding the terminal end of the base member 16 into the box trailer hitch 22, where it may be secured in place by the conventional hitch retaining pin 24. The forward stand section is installed by sliding the first base member 12 into the hollow confines of the base member 16 until a desired working distance between the front and rear cable clamp assemblies is obtained, whereupon the friction clamp 20 is tightened to positively secure the base members 12 and 16 together in that position. The distance between the cable clamp assemblies is adjusted as desired depending upon the thickness and type of cable being used. The thicker the cable, the greater the distance between clamp assemblies. The cable splicing stand is thus ready for use.

If it is desired or necessary that the stand be supported independently on its own leg members, the setup of the stand simply involves first sliding the leg member assembly 26, 30 onto the base member 12 and securing it in position by tightening clamp bolt 34 and then inserting the terminal end of the frame section 12 into the confines of the base member 16 and tightening clamp bolt 20 as described before, and finally connecting the other leg member assembly 28, 32 and clamping it in position by friction clamp 34. The stand is thus ready for use.

In situations where the ground may be particularly uneven or unsteady, or in situations where the stand might become unsteady when a cable strand is being pulled through the cable in splicing, the leg members may be spiked to a fallen tree or the like as seen in FIG. 3. Similarly, the legs may be bolted to a floor or staked to the ground for the same reasons if so needed.

With regard now to the actual use of the cable splicing stand of this invention, reference is first had to FIGS. 2 and 4 of the drawings. In proper initial condition before a cable is installed, the rotating plate member 60 is in the position shown in FIG. 4 in which the respective slots 58, 64 in the base plate 56 and the rotating plate 60 are aligned. The ratchet lock bar 68 is pivoted fully so as to clear the aligned slots, and a cable length is lain into the slot, the cable being drawn rearwardly through the rear bail assembly 46, whereupon the terminal end of the cable is then brought back through the bail assembly in the reverse direction as is clearly seen in FIG. 2. The cable thus forms a loop by virtue of the confining bail assembly which also retains the terminal end of the cable in the forwardly extending position shown. The chain 42' of the vise 42 is drawn around the cable as shown, and the vise operated to securely clamp the two diameters of cable tightly. The chain 74' of the front vise 74 is drawn around the cable and the vise operated to securely engage the single diameter of cable as shown.

The operator then rotates the front vise mounting assembly as has been described earlier. Because the cable is securely and immovably clamped by the vise 74 which is rotated in the direction opposite the wrappings of the cable, the cable is untwisted between the two vise members 42, 74 and gaps are thus opened between the individual strands of the cable. The ratchet mechanism prevents the assembly from inadvertently rotating in the reverse direction due to the significant inherent tension of the cable. Once the cable has been untwisted to a desired degree, typically about one revolution, the operator then simply unravels the cable strands from the terminal end of the cable that is not engaged by the rotating vise, and begins to simply weave the individual strands through the open spaces in the untwisted portion of the cable in the manner that is dictated by the particular type of splice that is being done. If desired, a conventional marlin spike can easily be inserted by hand through the spaces between the wound cable strands first to open up the desired space more broadly for easier passage of the cable strand end therethrough. But as understood, the spike no longer needs to be driven or hammered through the cable since it has already been untwisted.

As more and more strands are woven into the spaces in the intermediate unwound portion of the cable, less and less space becomes available, and the operator need only go back and rotate the cab le further to open up more spaces as he continues the splicing operation. Once the splice has been fully accomplished, the operator operates the ratchet assembly to allow the rotating vise assembly to turn in the opposite direction until the cable has returned to its normal condition of inherent tension. The splice is thus complete.

The chain vises are released, the bail assembly is opened so that it no longer retains the cable, and the cable, which now has a closed loop end in this example, is simply lifted out and the entire operation is complete. The foregoing splicing operation has just been described in connection with one person doing the entire job without the necessity of using brute strength, other workers assisting to untwist and hold the cable, the need of forceably driving spikes through the strands to open up individual spaces through which cable strands may be laboriously drawn through, or any of the other heretofore conventional and energy and time consuming exercises that have previously been required to accomplish cable splices in the field. Also eliminated are the common hazards of injuries resulting from the forced manipulation of tensioned cables with spikes and hammers, the slipping of spikes, and other common occurrences.

From the foregoing it will be apparent to those skilled in the art that various changes other than those already described may be made in the size, shape, type, number and arrangement of parts described hereinbefore without departing from the spirit of this invention and the scope of the appended claims. For example, as mentioned earlier the ratchet assembly shown is merely illustrative of one means to secure the assembly against rotation resulting from the inherent tension of the cable. Also, although the rotating vise assembly is shown in connection with one end of the stand, it could alternatively be provided as well on the opposite end if so desired. Moreover, it is to be understood that both vise assemblies could be configured for releasable rotation in order to minimize the amount of rotation required of just one assembly or for accomplishing different types of cable splicing than the closed loop type of splice illustrated herein. Additionally, various alternative drive arrangements could be provided if so desired as an alternative to the manual bar 78 arrangement shown herein for simplicity.

Having thus described my invention in the manner in which it may be used, I claim:

1. A cable splicing vise stand configured to receive a cable, assist in untwisting a length of the cable, and hold the cable in untwisted condition during the splicing of the cable, the stand comprising:

a) an elongated base frame;

b) a first cable-engaging clamp assembly on the base frame;

c) a second cable-engaging clamp assembly on the base frame;

d) said first and second cable engaging clamp assemblies disposed a spaced distance from each other and configured to securely and positively grip a cable at two spaced apart points which define between them a cable-splicing length of a cable;

e) clamp supporting means mounted rotatably on the frame and supporting one of said cable-engaging clamp assemblies to rotate the clamp assembly in a direction opposite the windings of a cable being gripped by the assemblies to untwist a cable and thereby loosen the windings of the individual strands of the cable between the clamp assemblies; and f) a ratchet assembly comprising a ratchet wheel and pawl releasably interengaging said rotatable clamp supporting means and base frame for releasably securing said rotatable clamp supporting means in any one of a plurality of positions of rotation relative to the base frame, the ratchet assembly configured to releasably secure the clamp assembly against reverse rotation resulting from the inherent tension of the cable being held in untwisted condition by the clamp assemblies.

2. The cable splicing stand of claim 1 including supporting leg means on the frame arranged to support the frame an elevated distance above a ground surface.

3. The cable splicing stand of claim 1 including a cable loop confining bail assembly on the frame associated with one of said cable engaging clamp assemblies, the bail assembly configured to maintain a length of looped cable in position closely adjacent the cable engaging clamp assembly prior to engagement of the cable of the clamp assembly.

4. A cable splicing vise stand configured to receive a cable, assist in untwisting a length of the cable, and hold the cable in untwisted condition during the splicing of the cable, the stand comprising:

a) an elongated base frame;

b) a first cable-engaging clamp assembly on the base frame;

c) a second cable-engaging clamp assembly on the base frame;

d) said first and second cable engaging clamp assemblies disposed a spaced distance from each other and configured to securely and positively grip a cable at two spaced apart points which define between them a cable-splicing length of a cable;

e) clamp supporting means mounted rotatably on the frame and supporting one of said cable-engaging clamp assemblies to rotate the clamp assembly in a direction opposite the windings of a cable being gripped by the assemblies to untwist a cable and thereby loosen the windings of the individual strands of the cable between the clamp assemblies, the clamp supporting means comprising a mounting base plate secured to the frame, a rotary plate member mounted on the base plate for rotation relative thereto, the base plate and rotary plate member having cable receiving slots therein arranged for mutual registration in one position of rotation of the rotary plate member for insertion of a cable therein, the rotary plate member being rotatable from said slot registration position to a position in which the slot in the rotary plate member extends across the slot in the base plate, whereby to secure a cable within said crossed slots, and f) locking means releasably interengaging said rotatable clamp supporting means and base frame for releasably securing said rotatable clamp supporting means in any one of a plurality of positions of rotation relative to the base frame, the locking means configured to releasably secure the clamp assembly against reverse rotation resulting from the inherent tension of the cable being held in untwisted condition by the clamp assemblies.

* * * * *